United States Patent [19]

Raasch et al.

[11] Patent Number: 4,736,898

[45] Date of Patent: Apr. 12, 1988

[54] MEANS FOR POSITIONING THE END OF YARN ON A CROSS-WOUND BOBBIN

[75] Inventors: Hans Raasch; Theo Lembeck; Hans-Werner Schwalm, all of Monchen-Gladbach, Fed. Rep. of Germany

[73] Assignee: W. Schlafhorst & Co., Monchen-Gladbach, Fed. Rep. of Germany

[21] Appl. No.: 5,473

[22] Filed: Jan. 20, 1987

[30] Foreign Application Priority Data

Jan. 29, 1986 [DE] Fed. Rep. of Germany ..... 3602574

[51] Int. Cl.[4] ..... B65H 54/02; B65H 54/22; B65H 67/00

[52] U.S. Cl. ..... 242/18 EW; 242/35.5 R; 242/35.5 A; 242/35.6 E

[58] Field of Search ..... 242/18 EW, 18 PW, 18 R, 242/18 DD, 35.5 R, 35.6 R, 35.6 E

[56] References Cited

U.S. PATENT DOCUMENTS

| | | | |
|---|---|---|---|
| 3,029,031 | 4/1962 | Furst | 242/35.6 R |
| 3,043,529 | 7/1962 | Furst | 242/35.6 R |
| 3,948,452 | 4/1976 | Burysek et al. | 242/18 PW |
| 4,138,072 | 2/1979 | Aoyama et al. | 242/18 EW X |
| 4,526,326 | 7/1985 | Bloomfield et al. | 242/18 EW X |
| 4,630,782 | 12/1986 | Rohner | 242/18 EW |

FOREIGN PATENT DOCUMENTS

| | | |
|---|---|---|
| 1760245 | 12/1971 | Fed. Rep. of Germany . |
| 3103879 | 9/1982 | Fed. Rep. of Germany . |
| 596074 | 2/1978 | Switzerland . |
| 616390 | 3/1980 | Switzerland . |

*Primary Examiner*—Stanley N. Gilreath
*Attorney, Agent, or Firm*—Shefte, Pinckney & Sawyer

[57] ABSTRACT

Means for positioning the end of yarn on a cross-wound bobbin on a textile machine. The machine has a traveling service mechanism that services the bobbins individually at winding heads of the machine. A yarn end take-in device in the form of a suction tube with a concave surface facing the bobbin and a nozzle against the bobbin searches for, takes in and draws off a yarn end from the bobbin. A yarn guiding device, in the form of an inclined slot in the suction tube or a pivoted guiding rod, guides the yarn end against a side of the bobbin. A yarn guide element on the winding head, on the creel or on the servicing mechanism is positioned with an oblique surface extending to an end adjacent the juncture of the bobbin side and bobbin tube to guide the yarn to the juncture for forming a yarn end reserve thereat.

13 Claims, 3 Drawing Sheets

MEANS FOR POSITIONING THE END OF YARN ON A CROSS-WOUND BOBBIN

BACKGROUND OF THE INVENTION

This invention relates to means for positioning the end of yarn on a cross-wound bobbin and more particularly for such means in a textile machine that has a plurality of winding heads and a traveling service mechanism that services the winding heads individually for a final treatment of the cross-wound bobbins after they have been released from their bobbin drive but are still held in the creel of the winding head between bobbin tube holding elements that are rotatably mounted in the creel, with a bobbin-rotating device that can move toward and away from the bobbin and with a yarn take-in deivce for searching for, taking and drawing off a yarn end that has been wound onto the surface of the cross-wound bobbin. The service mechanism can be, for example, a cross-wound bobbin changer, a piecer, a combination of both devices or any other mechanism that can travel on the machine.

It is desirable in many instances in the further processing of cross-wound bobbins to wind a yarn end onto an end of the bobbin tube as a yarn reserve or end reserve in order to be able to find the yarn end better in subsequent processing of the yarn.

Thus, German DE-OS No. 17 60 243 teaches that a strip can be pivoted upward about a pivot point located to the side of the bobbin directly in front of a yarn guide traveling back and forth in order to guide the yarn to one side of the bobbin. Such a device must be present on each bobbin, which results in a complicated and expensive mechanism.

The same publication discloses a friction roller driven in both directions of rotation and a suction tube connected to a suction blower with the roller and suction tube being movable onto a cross-wound bobbin mounted in a freely rotatable manner, with the suction opening of the suction tube extending over a part of the circumference and the entire length or a portion of the length of the bobbin.

This prior device takes up the bobbins removed from the winding head in order to process them and in doing so may catch the yarn in the path of the device such that it is difficult to locate. Moreover, such a device is very complicated due to the necessary feed and removal devices. Further, the possibility of using such a device is limited because it requires a considerable amount of space around and to the side of the bobbin which is not normally available in this type of machine for producing cross-wound bobbins.

DE-OS No. 25 06 930 teaches that the end reserve can be formed by removing the bobbin from the winding device and rotating it slowly counter to the direction of winding, pneumatically catching the yarn end and removing it with a suction gripper, with the mouth of the suction gripper pivoting to one end of the tube and delivering the yarn end to the tube. Since in this device the bobbin must be removed from the winding device, a complicated holding and drive device for the bobbin is necessary. Also, the gripper must execute complicated movements in order to grasp the yarn and deliver it to the tube, and the device can be used only in a limited manner because enough free space for the movements of the device is usually not present in machines that wind cross-wound bobbins.

SUMMARY OF THE INVENTION

The present invention serves to form a yarn end reserve that does not easily come loose by itself during subsequent transport of the bobbin, and avoids the above-indicated disadvantages of the prior art.

Briefly described, the means for positioning the end of yarn on a cross-wound bobbin according to the present invention is incorporated in a textile machine of the type that has a service mechanism that travels along the machine to serve bobbins in creels at winding heads after the individual bobbins have been wound and released from their drive and held in bobbin tube holding elements rotatably mounted in the creels. The service mechanism has a bobbin rotating device that moves into and out of rotating engagement with the bobbin. The yarn positioning means has a yarn end take-in device for searching for, taking-in and drawing off a yarn end that has been wound onto the surface of the bobbin. A yarn guiding device is mounted on the traveling service mechanism and copperates with the yarn take-in device for guiding the yarn end against one of the two sides of the bobbin. A yarn guide element cooperates with the yarn guiding device to guide the yarn end to the juncture of the bobbin side and the tube for retention thereat.

Advantageously, more complicated and bulky parts are disposed on the traveling service mechanism and, therefore, only one set of such components is necessary to service all of the winding heads. Only the less complicated yarn guide element is optionally needed at each winding head, so that the entire device is relatively simple and inexpensive without detracting from its universal application.

With the present invention a yarn end can be positioned for forming a yarn end reserve at the juncture of the bobbin and tube where the tube end is very short and/or if it has rounded edges and/or if it is a conically cross-wound bobbin because the bobbin construction covers the tube end more and more during the winding, causing the side of the bobbin to assume a concave form that hinders the formation of a yarn end reserve thereat.

The yarn take-in device may be combined with the yarn guiding device and/or a bobbin-rotating device in a component that can move toward and away from the bobbin. This reduces the number of movable parts and, in addition, the movable yarn take-in device can be used together with the bobbin-rotating device for ejection of the bobbin after the positioning of the yarn end and after the release of the bobbin from its tube holding elements.

Preferably, the yarn take-in device is in the form of a pivotable suction tube having a concave surface extending toward the bobbin and having a suction nozzle facing the bobbin and extending beyond the aforesaid one side of the bobbin. The yarn guiding device is in the form of a slot in the concave surface of the suction tube and opens into the suction nozzle beyond the side of the bobbin and extending in the concave surface at an inclination to the direction of the flow of suction in the tube.

With this arrangement, when the bobbin is reversely rotated, the yarn end is first taken in by suction, with the yarn entering the slot facing the bobbin. When the bobbin is subsequently driven in the winding direction, the yarn slides into the slot and down the slot to the end beyond the side of the bobbin, from where it is then guided by the yarn guide element to the juncture of the bobbin side and the tube. The yarn now winds up at this juncture, making contact with the side of the bobbin and clinging as a result of the yarn hairiness to the bobbin side.

Alternatively, the yarn guiding device may be a yarn guide rod that moves between the bobbin and the yarn take-in device to guide the yarn mechanically to the side of the bobbin.

In the preferred embodiment of the present invention, the yarn guide element is contoured obliquely toward the juncture of the bobbin side and the tube and terminates adjacent the juncture. As a consequence, the yarn end slides along the yarn guide contour, so that it is forced to the juncture.

In order to be able to lock in and release the bobbin in an unimpeded manner, a further embodiment of the present invention has the yarn guide element movably mounted on the creel so that it can move toward and away from the bobbin and is operated by an actuating element. The yarn guide element can be pivotably mounted, for example, and be pivoted back when the bobbin is to be doffed.

In a further embodiment of the present invention, the yarn guide element is a part of a tube holding and centering device that is rotatably mounted on the creel and extends over the tube end. If the tube holding and centering device has three gripping claws, for example, then these gripping claws can be designed as yarn guide elements. The gripping claws are spaced, for example, at only a short distance from each other and their guide contours are conical.

The invention will now be explained and described in more detail with reference made to the schematically shown embodiments.

DETAILED DESCRIPTION OF THE PREFERRED EMBODIMENTS

Figure 1:
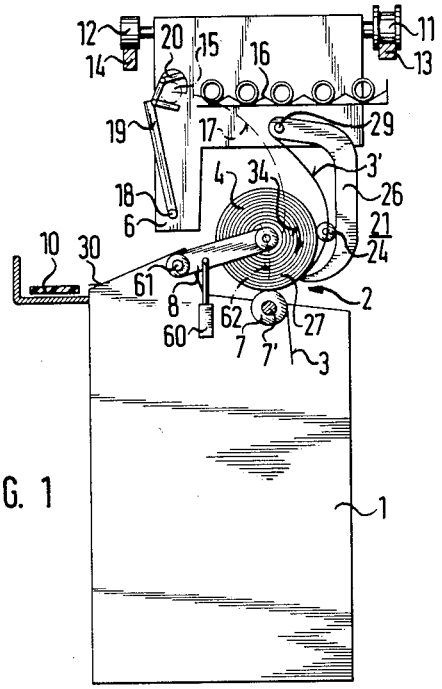
FIG. 1 is a schematic side elevation of a winding station of a textile machine incorporating means for positioning a yarn end according to the preferred embodiment of the present invention.

In the preferred embodiment of FIGS. 1 to 4, the yarn end positioning means is incorporated in a textile machine 1, e.g. an open-end spinning machine, which produces cross-wound bobbins at a plurality of winding heads 2 which have the function of winding up the spun or supplied yarn 3 to cylindrical cross-wound bobbins 4.

A traveling service mechanism 6 that services the winding heads individually one after the other is in the form of a bobbin changer to provide the final treatment of a wound bobbin 4 that has already been loosened from its bobbin drive 7 but is still held between tube holding elements 9,9' rotatably mounted in the creel 8,8'. The final treatment consists in this embodiment of removing the bobbin from the creel 8,8' and rolling it onto a bobbin conveyor belt 10 running to the end of the machine.

The bobbin changer also has other tasks to fulfill which will be discussed in more detail later. It is supported by guide rollers 11,12 on tracks 13,14 and carries a limited supply of empty tubes 15 in a tube magazine 16.

A tube feeder 19 which can pivot along a circular arc 17 about a pivot point 18 is provided with a tube gripping device 20. As soon as the bobbin 4 has been removed from the creel 8,8', the tube gripping device 20 pivots a new empty tube 15 down along the circular arc 17 and plavces the tube 15 in front of the two tube holding elements 9,9' of the creel 8,8'. The creel 8,8' locks in the new tube and when the tube feeder 19 then moves back into its initial position, the tube gripping device 20 slides in a yielding manner off the tube 15, which is now locked in the creel, and the gripping device is in position to subsequently receive the next tube from the tube magazine 16.

A yarn take-in device designated in its entirety by the numeral 21 is combined with a yarn guiding device 22 and a bobbin-rotating device 24 to a component which can move toward and away from the bobbin 4. The yarn take-in device 21 includes a slot-like suction nozzle 25 which is located on the end of a pivotable suction tube 26 that has a concave surface extending toward the bobbin 4 with the nozzle 25 against the bobbin 4 and extending beyond one side, namely, the front side 27 in FIG. 2, of the bobbin 4. The yarn guiding device 22 is in the form of a slot in the aforesaid concave surface of the suction tube facing the bobbin 4, which slot opens into the end of the suction nozzle 25 beyond the side 27 of the bobbin and extends in the concave surface at an inclination to the direction of flow of suction in the tube 26.

The bobbin drive 7 consists of a friction roller which can be driven by a shaft 7' rotatably mounted along the machine.

The suction tube 26 of the yarn take-in device 21 can pivot about a pivot point 29 between an operating position against the bobbin, as shown in FIG. 1, to a position to the right in FIG. 1 where it is away from the bobbin 4. However, it can also be pivoted to the left out of the position shown in FIG. 1, in order to roll the bobbin 4 over a roll surface 30 onto the bobbin conveyor belt 10.

Figure 2:
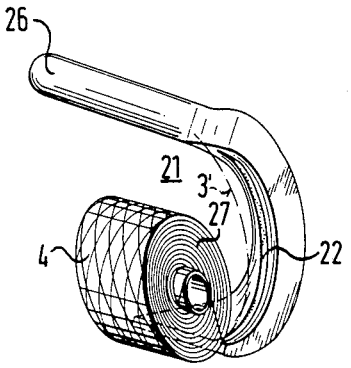
FIG. 2 is a perspective view of the yarn take-in device and the yarn guiding device of the yarn end positioning means of FIG. 1.
Figure 3:
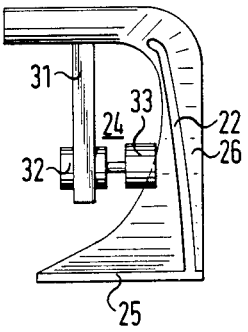
FIG. 3 is a rear elevation of the yarn take-in device and the yarn guiding device of FIG. 2.

The bobbin-rotating device 24 includes a holder 31 having one end connected to the suction tube 26 and the other end carrying an electromotor 32 that drives a drive roller 33 selectively in bobbin winding and unwinding directions. The drive roller 33 first drives the bobbin 4 by friction in a direction opposite the direction of the arrow 34, to cause the yarn end 3' to be taken in by the suction nozzle 25 loaded with suction air and continuously drawn off the bobbin. The yarn 3' does not yet pass into the slot 22, because this slot opens laterally outside the bobbin 4. If the slot 22 assumes an oblique course, as shown in FIGS. 2,3, so that it crosses the direction of suction, the taken-in yarn 3' has an even lesser tendency to exit from the slot 22. When the bobbin 4 is subsequently driven in the opposite direction, the direction of the arrow 34, the yarn 3' slides as a consequence of the friction in the concave tube into the slot 22 and exits from the slot, as is indicated in FIGS. 1,2. Now the yarn 3' follows the course of the slot 22 downward and passes laterally along the side 27 of the bobbin 4 out of the slot 22. It passes thereby to the tube holding element 9 shown in particular in FIG. 4, that consists of a tube holding and centering device 9 that is rotatably mounted on the creel 8 and extends over the end 35 of the tube 36 of the bobbin 4. The tube holding and centering device 9 comprises, for example, a total of three yarn guide elements that are evenly distributed over the circumference with only the guide elements 37 and 38 visible in FIG. 4. Each yarn guide element has a conical thread guide contour that is directed obliquely toward the juncture 41 formed by the bobbin side 27 and the tube 36 and which terminates adjacent this juncture 41. The yarn guide element 37 has a yarn guide contour 42 and the yarn guide element 38 has a yarn guide contour 43. The yarn guide contours of the yarn guide elements, which are spaced with only a slight distance from each other, form an acute angle with the side 27 of the bobbin 4.

Figure 6:
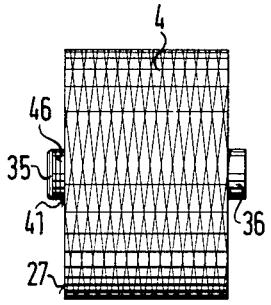
FIG. 6 is an elevation of a cylindrical bobbin showing the start-up end reserve and the wound yarn end reserve.

As soon as the yarn 3' leaves the slot 22, it is automatically guided by the yarn guide contours 42,43 to the juncture 41, where it then forms the yarn end reserve 46 in accordance with FIG. 6. Instead of the clawlike yarn guide elements, a single yarn guide element provided with a conical yarn guide contour could be used.

After the yarn end reserve 46 has been formed, the creel 8,8' can be spread or opened in the direction of the arrows 48,49 by means which are not shown here, whereby the bobbin 4 is freed so that the suction tube 26, which continues to pivot, can rol it onto the bobbin conveyor belt 10.

While the tube feeder 19 is subsequently setting a new tube into the creel 8,8', the suction tube 26 pivots out of the position shown in FIG. 1 further to the right so as not to interfere with the further travel of the service mechanism 6. The further travel can be initiated as soon as the tube feeder 19 reassumes the initial position shown in FIG. 1 after having inserted a new tube.

The described activities can occur according to a set program stored, for example, in sets of cam disks in the interior of the service mechanism 6. The electromotor can also be turend on and off and switched to forward and reverse operation according to the program.

Figure 4:
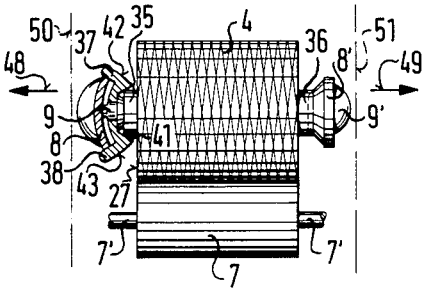
FIG. 4 is an elevation of yarn guide elements on a tube holding and centering device extending over the tube end according to the preferred embodiment of the present invention.

The limits of a work station are indicated in FIG. 4 by dotted lines 50 and 51, which illustrates the limited spatial condition within which the device of the invention can effectively operate.

Figure 7:
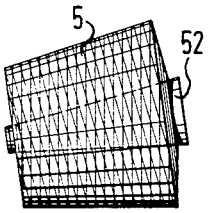
FIG. 7 is an elevation of a conical bobbin.

Not only cylindrical bobbins 4 but also conical bobbins 5 in accordance with FIG. 7 can receive a yarn end reserve with the aid of the device of the invention, even though, as is clearly visible in FIG. 7, the winding overlaps the particular smaller end of the tube, designated here by 52, to a great extend and even though this tube end is also rounded in order to simplify the later running off of the yarn.

Figure 8:
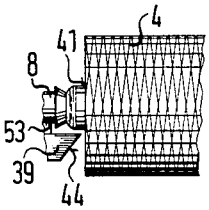
FIG. 8 is an elevation of a bobbin and an alternative embodiment of a yarn guide element.

It is quite apparent in the alternative embodiment of a yarn guide element 38 with its yarn guide contour 44 shown in FIG. 8 to what extend the guide contour 44 can guide a yarn into the juncture 41. The yarn guide element 39 is connected here by a holder 53 to the creel 8. It could also have the form of a truncated cone positioned concentrically to the bobbin axis.

Figure 9:
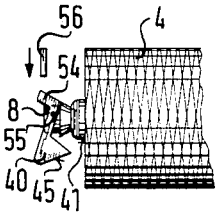
FIG. 9 is an elevation of another alternative embodiment of a yarn guide element.

In the alternative embodiment of a yarn guide element 40 according to FIG. 9, the yarn guide contour is designated by 45. This yarn guide element 40 is mounted, as by pivoting about a pivot point 55, on the creel 8 in such a manner that it can move toward and away from the bobbin 4 and is engaged by an actuating element 54, in the form of a lever, to effect movement of the element into operating position. It is returned to a non-operating position as shown in FIG. 9 under the action of a wound spiral spring, which is not shown. If a yarn end reserve is to be wound, a shift lever 56 either from the winding head 2 or from the service mechanism 6 can actuate the lever 54 in order to bring the end of the yarn guide element 40 into position adjacent the juncture 41.

Figure 5:
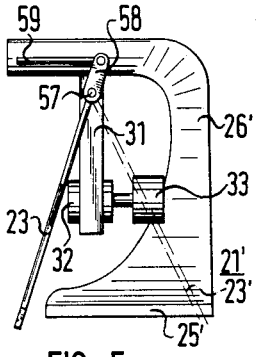
FIG. 5 is a rear elevation of an alternative embodiment of the yarn take-in device and the yarn guiding device.

In the alternative embodiment of a yarn guide device 23 according to FIG. 5, the suction tube 26' has no slot. Rather, the yarn guiding device 32 consists of a yarn guiding rod 23 that can move between the bobbin 4 and the yarn take-in device 21' at the level of the suction nozzle 25', and can pivot about a pin 57 connected to the holder 31. The yarn guiding rod 23 thus forms a two-armed lever, to the lever end 58 of which a shift rod 59 is articulated. The shift rod 59 terminates in the service mechanism 6 and is actuated at the proper time to move the yarn guiding rod 23 from the rest position shown in FIG. 5 into the work position 23' shown in dotted lines, whereby a yarn taken in previously by suction is guided to the side 27 of a bobbin that may be a cylindrical bobbin 4 or a conical bobbin 5.

FIG. 1 shows that the bobbin 4 has already been lifted off the bobbin drive 7. This can be performed, for example, by a pneumatic lifting device 60 at the particular winding head 2. In order to insert a new tube, the lifting device 60 is made to pivot the creel 8,8' down, whereby it rotates about the pivot axis 61 and the tube holding elements 9,9' move down along a circular arc 62.

Figure 10:
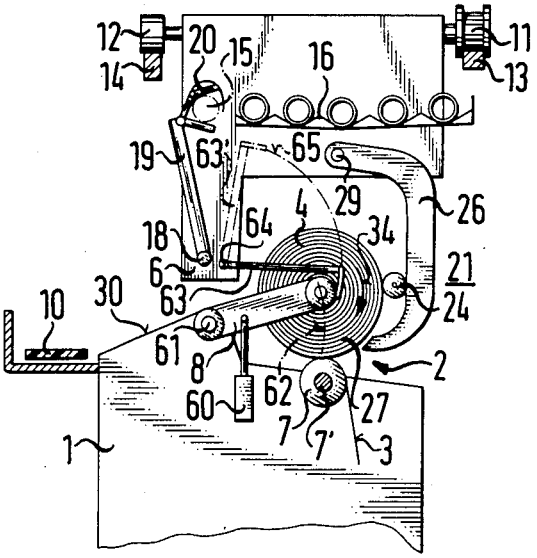
FIG. 10 is a side elevation of an alternative embodiment of the present invention.
Figure 11:
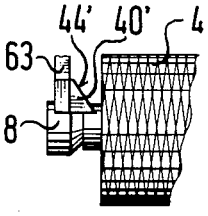
FIG. 11 is an elevation of the yarn guide element of the embodiment of FIG. 10.

With the following exceptions, the alternative embodiment of FIGS. 10 and 11 corresponds to the embodiments of FIGS. 1 and 8. The yarn guide element 40' with its yarn guide contour 44' rests on the end of a lever 63 which is located on the service mechanism 6 and can pivot about the pivot point 64, whereby the yarn guide element describes a circular arc 65. In order to form the yarn end reserve, the lever 63 is pivoted down out of its base position 63' until it comes to rest against a part of the creel 8.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Means for positioning the end of yarn on a cross-wound bobbin on a textile machine of the type having winding heads operable to cross-wind yarn to form bobbins and includng means for releasing wound bobbins, creels at said winding heads for supporting wound bobbins released by said winding heads, said creels having bobbin tube holding means rotatably mounted thereon, a service mechanism movable along the machine and having means thereon for servicing bobbins held by said bobbin tube holding means and including a bobbin rotating device movable into and out of rotating engagement with the bobbin, said yarn end positioning means comprising a yarn end take-in device for searching for, taking in and drawing off a yarn end that has been wound onto the surface of the bobbin, a yarn guiding device mounted on said traveling service mechanism and cooperating with said yarn takein device for guiding the yarn end against one of the two sides of the bobbin, and a yarn guide element cooperating with said yarn guide device to guide the yarn end to the juncture of said one bobbin side and the tube for retention thereat.

2. Yarn end positioning means according to claim 1 and characterized further by means mounting said yarn guide element on said traveling service mechanism for movement therewith to said winding heads.

3. Yarn end positioning means according to claim 1 and characterized further in that said mounting means mounts a said yarn guide element at each winding head.

4. Yarn end positioning means according to claim 3 and characterized further in that said mounting means mounts said yarn guide elements on the creel at each winding head.

5. Yarn end positioning means according to claim 1 and characterized further by means for moving said yarn take-in device toward and away from the bobbin.

6. Yarn end positioning means according to claim 1 and characterized further in that said yarn take-in device comprises a pivotable suction tube having a concave surface extending toward the bobbin and having a suction nozzle facing the bobbin and extending beyond said one side of the bobbin, and in that said yarn guiding device comprising a slot in said concave surface of said suction tube opening into said suction nozzle beyond said side of the bobbin and extending in said concave surface at an inclination to the direction of suction in said tube.

7. Yarn end positioning means according to claim 1 and characterized further in that said yarn guiding device comprises a thread guiding rod between the bobbin and said yarn take-in device.

8. Yarn end positioning means according to claim 1 and characterized further in that said yarn guide element is contoured obliquely toward said juncture of said one bobbin side and said tube and terminates adjacent said juncture.

9. Yarn end positioning means according to claim 6 and characterized further in that said yarn guide element is contoured obliquely toward said juncture of said one bobbin side and said tube and terminates adjacent said juncture.

10. Yarn end positioning means according to claim 7 and characterized further in that said yarn guide element is contoured obliquely toward said juncture of said one bobbin side and said tube and terminates adjacent said juncture.

11. Yarn end positioning means according to claim 1 and characterized further by means for mounting said yarn guide element on the creel for movement toward and away from the bobbin, and an actuating element engagable with said yarn guide element to effect movement thereof.

12. Yarn end positioning means according to claim 1 and characterized further by a tube holding and centering device rotatably mounted on the creel and extending over the end of the bobbin tube, said yarn guide element being incorporated in said tube holding and centering device.

13. Yarn end positioning means according to claim 12 and characterized further in that said yarn guide element is contoured obliquely toward said juncture of said one bobbin side and said tube and terminates adjacent said juncture.

* * * * *